United States Patent [19]

Baumert et al.

[11] Patent Number: 4,514,281

[45] Date of Patent: Apr. 30, 1985

[54] CORROSION INHIBITION FOR DISTILLATION APPARATUS

[75] Inventors: Kenneth L. Baumert, Emmaus, Pa.; Alberto A. Sagues, Lexington; Burtron H. Davis, Georgetown, both of Ky.; Frank K. Schweighardt, Upper Macungie, Pa.

[73] Assignee: International Coal Refining Company, Allentown, Pa.

[21] Appl. No.: 591,665

[22] Filed: Mar. 21, 1984

[51] Int. Cl.[3] ..... C10G 7/10; C10G 45/02

[52] U.S. Cl. ..... 208/47; 208/262; 208/349

[58] Field of Search ..... 208/47, 349, 262; 585/820

[56] References Cited

U.S. PATENT DOCUMENTS 3,779,905 12/1973 Stedman ..... 208/47

3,862,900 1/1975 Reusser ..... 208/262

*Primary Examiner*—Delbert E. Gantz

*Assistant Examiner*—Chung K. Pak

*Attorney, Agent, or Firm*—Kimbley L. Muller

[57] ABSTRACT

Tower material corrosion in an atmospheric or sub-atmospheric distillation tower in a coal liquefaction process is reduced or eliminated by subjecting chloride-containing tray contents to an appropriate ion-exchange resin to remove chloride from such tray contents materials.

3 Claims, 2 Drawing Figures

CORROSION INHIBITION FOR DISTILLATION APPARATUS

The Government of the United States of America has rights in this invention pursuant to Contract No. DE-AC05-780R03054 (as modified) awarded by the U.S. Department of Energy.

BACKGROUND OF THE INVENTION

A necessary step in the production of solvent refined coal (SRC) and other coal liquefaction products is a solvent fractionation or distillation step. Such fractionation is usually accomplished in a distillation tower at atmospheric or below atmospheric pressures. It has been found that the synergistic reaction which contributes to corrosion in the tower involves chloride containing species in combination with low boiling weakly basic nitrogen containing streams and phenols. These lower boiling nitrogen containing streams distill upwardly in the tower until they reach a level where they remain in solution due to a combination of boiling point and solubility factors. Chloride containing fractions flow down the column. The low boiling nitrogen compounds, by forming the amine hydrochloride, provide a means of holding the chloride in the tower thus allowing corrosion due to prolonged contact with the acidic hydrochloride species. The location of this amine hydrochloride formation depends upon the boiling point, solubility, and base strength of the amines on the particular tray within the tower. In general, though, the higher boiling heavier nitrogen compounds are more strongly basic and so tend not to form amine hydrochlorides. It is the presence of such amine hydrochlorides which contributes greatly to corrosion of tower materials. It has been found that the chemical makeup of the coal liquids within the fractionation tower are highly corrosive. Corrosion rates on the order of 1,000 mpy (mils per year) have been reported for stainless steel tower materials. The severity of this corrosion has required the relining, retraying, or total replacement of fractionation apparatus.

PRIOR ART

In an effort to reduce or eliminate corrosion in coal liquid fractionation towers, several methods have been tested and/or used. These techniques are usually directed to neutralizing the coal liquid streams. Towers used in coal tar distillation have been maintained at low levels of corrosion by the injection of sodium carbonate into the tower as a solution. In such methods, however, the solvent flashes and resulting sodium carbonate solid drops out near the injection point. As a result, the tower has a tendency to plug near the injection point and must be taken out of service for frequent cleaning.

Injection of sodium hydroxide to the tower has also been used. Because sodium hydroxide is a stronger base, the quantities required to prevent corrosion are lower. However, polymerization of hydrocarbons in the tower is promoted by the strength of the base and polymerized hydrocarbons may plug the tower.

Sodium carbonate addition to feed coal has proven to be effective at reducing corrosion of the fractionation apparatus. However, approximately 1.5 times stoichiometric amounts are needed because of competing reactions with aluminum, silicon, and sulfur. In addition, most of the sodium ends up in the ash and is thus detrimental to the process gasifier. Finally, this amount of sodium carbonate addition to the process is extremely costly.

Other techniques such as water washing the incoming stream and side stream draw off have been considered and tested in the laboratory. These techniques are either impractical due to energy considerations or present problems in dealing with the waste they create.

OBJECTIVES OF THE INVENTION

It is a primary object of the present invention to substantially reduce or eliminate corrosion in the coal liquid fractionation tower of a coal liquefaction facility.

It is yet another object of the present invention to reduce or eliminate coal liquid fractionation tower corrosion while maintaining both energy efficiency and economy.

It is a further object of this invention to eliminate coal liquid fractionation tower corrosion while not contributing to tower plugging.

SUMMARY OF THE INVENTION

It has been determined that the corrosive constituents in coal liquids are phenols, basic nitrogen compounds, and certain water soluble chlorides. These three constituents interact synergistically to corrode iron based alloys in a reaction with an approximate ultimate stoichiometry of:

$$Fe+2HCl-FeCl_2+H_2 \quad (1)$$

Thus, the formation of acidic hydrochlorides is the primary contributor to corrosion of tower construction materials. Prior attempts to neutralize these hydrochlorides have been unsuccessful or less effective than is desirable due to side effects such as tower plugging.

BRIEF DESCRIPTION OF THE INVENTION

The present invention reduces formation of the acidic amine hydrochlorides primarily responsible for corrosion in coal liquefaction system fractionation systems by reducing the amount of chloride ion present in the fractionation tower.

This is accomplished by passing the chloride-containing tray contents through an appropriate ion-exchange resin bed.

DETAILED DESCRIPTION OF THE INVENTION

It has been found that chloride-containing species tend to accumulate generally in the 400° to 450° F. range of the fractionation tower. In conventional systems, the migration of the lower boiling nitrogen compounds from the feed point to the top of the tower allows intimate contact and reaction to form amine-hydrochlorides. By reducing the chloride ion concentration in the 400° to 450° F. range trays using ion exchange techniques, the formation of the amine-hydrochloride compounds which have been found to contribute significantly to tower material corrosion can be retarded or prevented.

Figure 1:
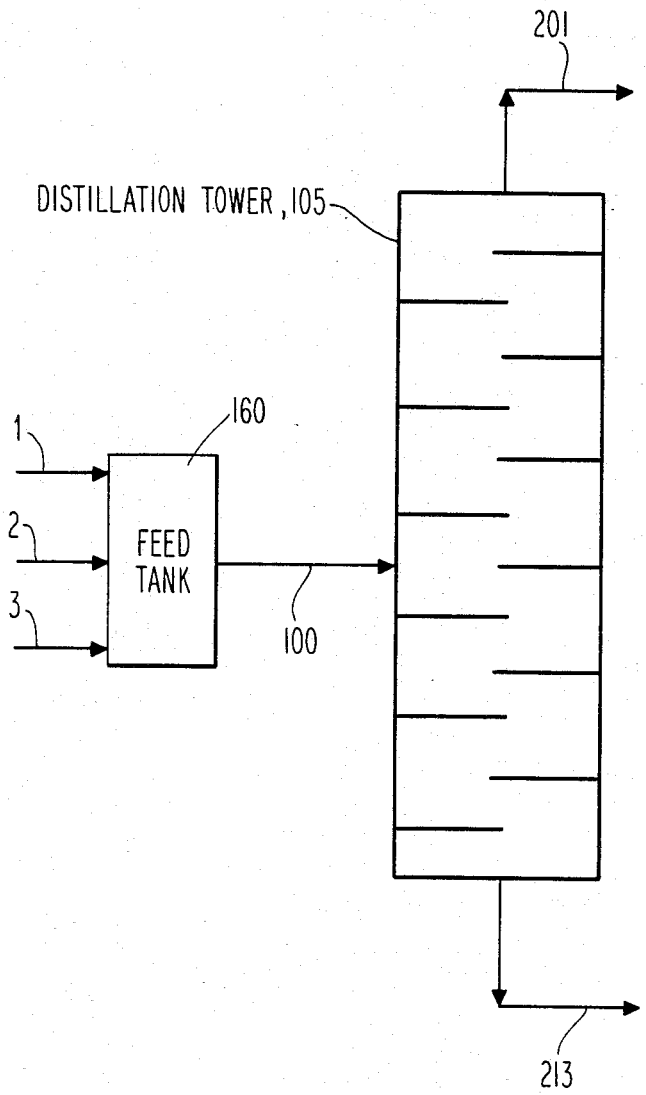
PRIOR ART Fig. 1
FIG. 1 is a block diagram of the fractionation tower of the prior art.

Referring now to FIG. 1, which describes a system typical of the prior art, all coal liquid streams (containing nitrogenous compounds) represented by inlet lines 1, 2 and 3 are mixed together in tower feed tank 160 and subsequently fed to atmospheric tower 105. Line 213 provides an exit path for tower-underflow materials of a non-volatile nature while line 201 provides an exit path for the high boiling and gas fractions.

Figure 2:
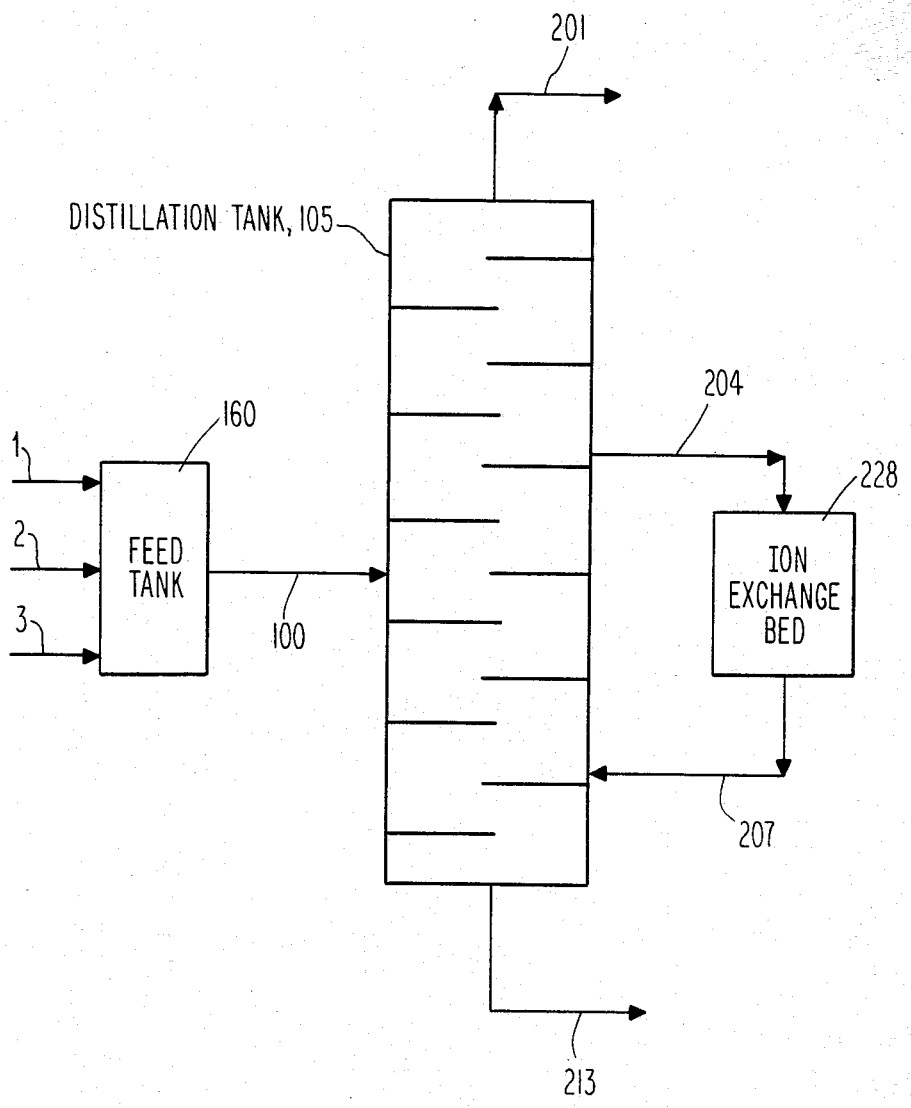
FIG. 2 is a block diagram of the preferred embodiment of the fractionation tower of the present invention.

Referring now to FIG. 2, which shows an schematic diagram of the present invention, coal liquid streams (containing nitrogenous compounds) represented by inlet lines 1, 2 and 3 are mixed together in tower feed tank 160. Tower feed tank contents are transferred to tower 105 via line 100. Tower 105 is an atmospheric distillation tower constructed of specialty materials to reduce corrosion. Tower 105 contains a plurality of trays containing materials which are differentiated by boiling point. Tower 105 further has take-off lines 201, 204 and 213. Line 213 provides an exit path for tower underflow materials of a non-volatile nature. Line 201 provides an exit path for the highest boiling and gas fractions. Line 204 transfers material from the trays within the 400° to 450° F. range to ion exchange bed 228. Within ion exchange bed 228, materials from the 400° to 450° range tower of 105 are treated to remove chloride-containing species. Reduced chloride materials are transferred back to tower 105 via line 207 for redistillation.

Ion exchange bed 228 may be either a continuous or fixed resin bed system. In a continuous system, the liquid passes down the bed while the resin traverses the bed in an upward direction. Chloride is removed to a low level in this system and low chloride content liquids exit the bottom of the bed. In a fixed bed arrangement, two columns are used to treat tower liquids. As one column's resin becomes exhausted, the flow is switched to the alternate column. The first column is then placed in a regeneration loop. This method approximates the performance of a continuous bed system.

The resins to be employed in these columns include basic resins which are compatible with the non-aqueous coal liquid stream. Such resins must not dissolve or lose their ion-exchange capacity due to the non-aqueous environment of the coal liquid stream. Resins such as Basic Dowex TM or Amberlite TM are appropriate.

The selection of appropriate tray content material for ion exchange treatment involves a determination of the concentration of the active chloride amine complex responsible for tower material corrosion. Such identification can be made by subjecting the tray material to high resolution capillary gas chromatography with a selective element detector detecting nitrogen or chlorine. The species determined to contain the active chloride-amine complex are then treated by ion exchange to remove the chloride component and returned to a lower point in the distillation tower.

What is claimed is:

1. In a coal liquifaction system including a distillation tower having trays for holding distilling materials, the improvement wherein chloride-amine-complex-containing-streams accumulated in the 400° to 450° F. range trays of said tower are removed from said tower, contacted with a chloride ion exchange material for removal of a substantial fraction of said chloride contained in said streams, and returned to said tower for further distillation.

2. The system of claim 1, wherein said chloride-ion exchange material is contained in a continuous bed.

3. The system of claim 1, wherein said chloride-ion exchange material is contained in a fixed bed.

* * * * *